US010045678B2

(12) United States Patent
Hay et al.

(10) Patent No.: US 10,045,678 B2
(45) Date of Patent: Aug. 14, 2018

(54) CLEANING DEVICE

(71) Applicant: HAYCO MANUFACTURING LIMITED, Hong Kong (HK)

(72) Inventors: Christopher Hay, Hong Kong (HK); Simeon Charles Jupp, Hong Kong (HK); Greg Clegg Spooner, Hong Kong (HK); Hoss Vong, Hong Kong (HK)

(73) Assignee: HAYCO MANUFACTURING LIMITED, Hong Kong (HK)

( * ) Notice: Subject to any disclaimer, the term of this patent is extended or adjusted under 35 U.S.C. 154(b) by 56 days.

(21) Appl. No.: 15/263,454

(22) Filed: Sep. 13, 2016

(65) Prior Publication Data

US 2017/0071438 A1 Mar. 16, 2017

(30) Foreign Application Priority Data

Sep. 16, 2015 (HK) ..... 15109057

(51) Int. Cl.
*A47L 13/256* (2006.01)
*A47L 13/44* (2006.01)

(52) U.S. Cl.
CPC ..... *A47L 13/256* (2013.01); *A47L 13/44* (2013.01)

(58) Field of Classification Search
CPC ..... A47L 13/256; A47L 13/44; A47L 13/46
See application file for complete search history.

(56) References Cited

U.S. PATENT DOCUMENTS 3,099,855 A * 8/1963 Nash ..... A47L 13/29 15/231
3,991,431 A 11/1976 Thielen
4,852,210 A * 8/1989 Krajicek ..... A47L 13/20 15/144.2

* cited by examiner

*Primary Examiner* — Shay Karls
(74) *Attorney, Agent, or Firm* — Heslin Rothenberg Farley & Mesiti P.C.; Victor A. Cardona, Esq.; Melvin Li, Esq.

(57) ABSTRACT

A surface cleaning device, such as a floor mop, has a handle via which a user holds on to the device and maneuvers the device during use, a head to which the handle connects, a base at which the head is secured and is situated, in normal use, below the head. The base is provided with, in normal use, a lower surface for engaging a surface to be cleaned via a removable or disposable substrate material, wherein the base is provided with a plurality of grippers for securing the disposable substrate material, the base and the grippers belong to an integral component.

19 Claims, 4 Drawing Sheets

CLEANING DEVICE

CROSS REFERENCE TO RELATED APPLICATION

This application claims priority from Hong Kong Patent Application No. 15109057.4 filed Sep. 16, 2015, contents of which are incorporated in its entirety.

FIELD OF THE INVENTION

The present invention is concerned with a surface cleaning device such as a floor mop, and a method of making thereof.

BACKGROUND OF THE INVENTION

There are a variety of floor cleaning devices in the market. While most of them are effective in achieving the function of cleaning many of them suffer from different problems such as high cost of manufacturing, durability or ease of use.

The present invention seeks to provide an improved surface cleaning device which can address these problems at least to some extent, or to provide the public with alternatives.

SUMMARY OF THE INVENTION

According to a first aspect of the present invention, there is provided a surface cleaning device comprising a handle at which a user holds on to d device and maneuvers the device during use, a head to which the handle connects, a base at which the head is secured and is situated, in normal use, below the head, in that the base is provided with, in normal use, a lower surface for engaging a surface to be cleaned via a removable or disposable substrate material, wherein:— i) the base is provided with a plurality of grippers for securing the disposable substrate material, both the base and the grippers belong to an integral component; and ii) the integral component of the base and the grippers is made of essentially thermoplastics elastomer (TPE) and formed by injection molding in one step.

Preferably, the base of the integral component may resemble a sleeve and include on one side a planar member defining the lower surface and on an opposite side the grippers, and wherein a cavity is defined between the grippers and the planar member for accommodating the head.

Advantageously, the head may be sized and shaped to fit within the cavity of the base of the integral component.

Suitably, the surface cleaning device may be sized and shaped such that the head may be securable within the base of the integral component by sliding into said base of the integral component from an opening at one lateral end of the sleeve.

In an embodiment, the head may be provided with apertures located beneath the grippers, the apertures for receiving tugged edges of the removable or disposable substrate.

In one embodiment, the base may have a cutout region via which connection means connecting the head and the handle protrudes.

In a specific embodiment, the base may be provided with an outwardly facing surface adjacent the grippers, the surface being roughened for improving frictional engagement of the removable or disposable substrate to the base during use.

In a different embodiment, the base and the head may be secured together by snap-fitting together. The base may include a planar member defining the lower surface and the integrally grippers may be raised from said planar member. The planar member may be provided with a thickened rim. The head may be provided with apertures, and may be configured such that on assembly said grippers are exposed or at least accessible for securing tugged edges of the removable or disposable substrate. Preferably, the base may be adapted to allow the removable or disposable substrate to wrap around the planar member.

In an embodiment, the surface cleaning may be configured such that the handle may be pivotably swivable in forward, rearward or sideway direction.

In one embodiment, the surface cleaning device may be provided with four grippers located at four corners of the base.

According to a second aspect of the present invention, there is provided a surface cleaning device comprising a handle via which a user holds on to the device and maneuvers the device during use, a head to which the handle connects, a base at which the head is secured and is situated, in normal use, below the head, in that the base is provided with, in normal use, a lower surface for engaging a surface to be cleaned via a removable or disposable substrate material, wherein the base is provided with a plurality of grippers for securing the disposable substrate material, the base and the grippers belong to an integral component. Preferably, the integral component of the base and the grippers may be made of essentially thermoplastics elastomer (TPE) and formed by injection molding in one step.

BRIEF DESCRIPTION OF THE DRAWINGS

Some embodiments of the present invention will now be explained, with reference to the accompanied drawings, in which:—

DETAILED DESCRIPTION OF PREFERRED EMBODIMENTS OF THE INVENTION

The present invention is concerned with a surface cleaning device or more particular a floor mop.

Figure 1:
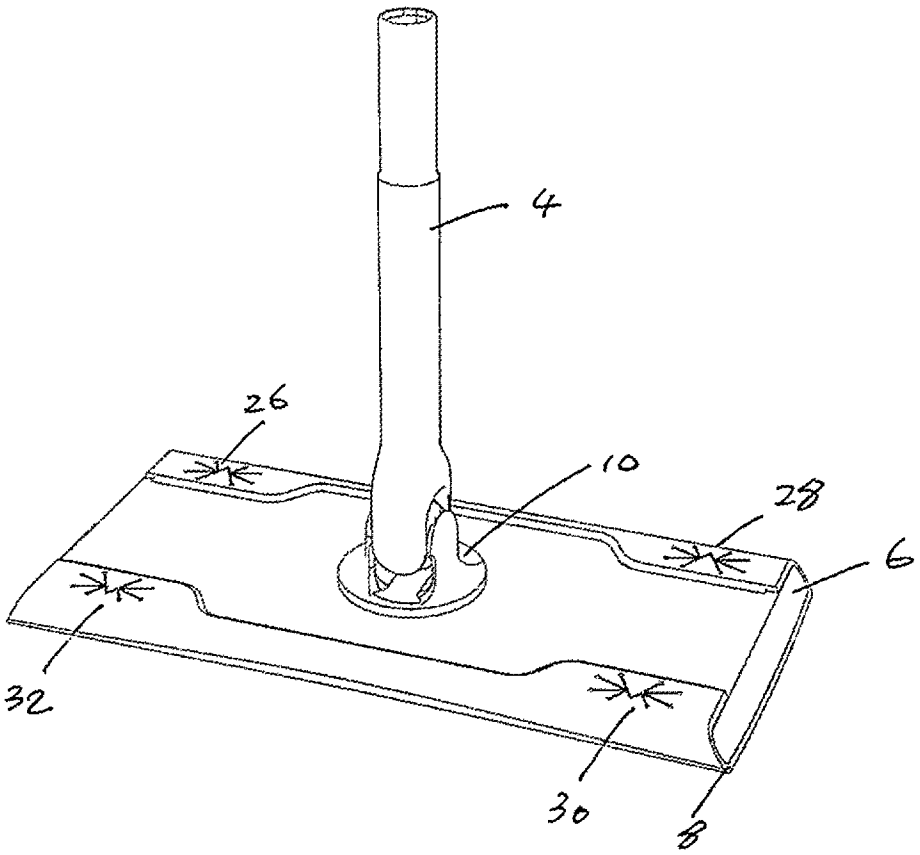
FIG. 1 is a perspective view of an embodiment of a surface cleaning device according to the present invention.
Figure 2:
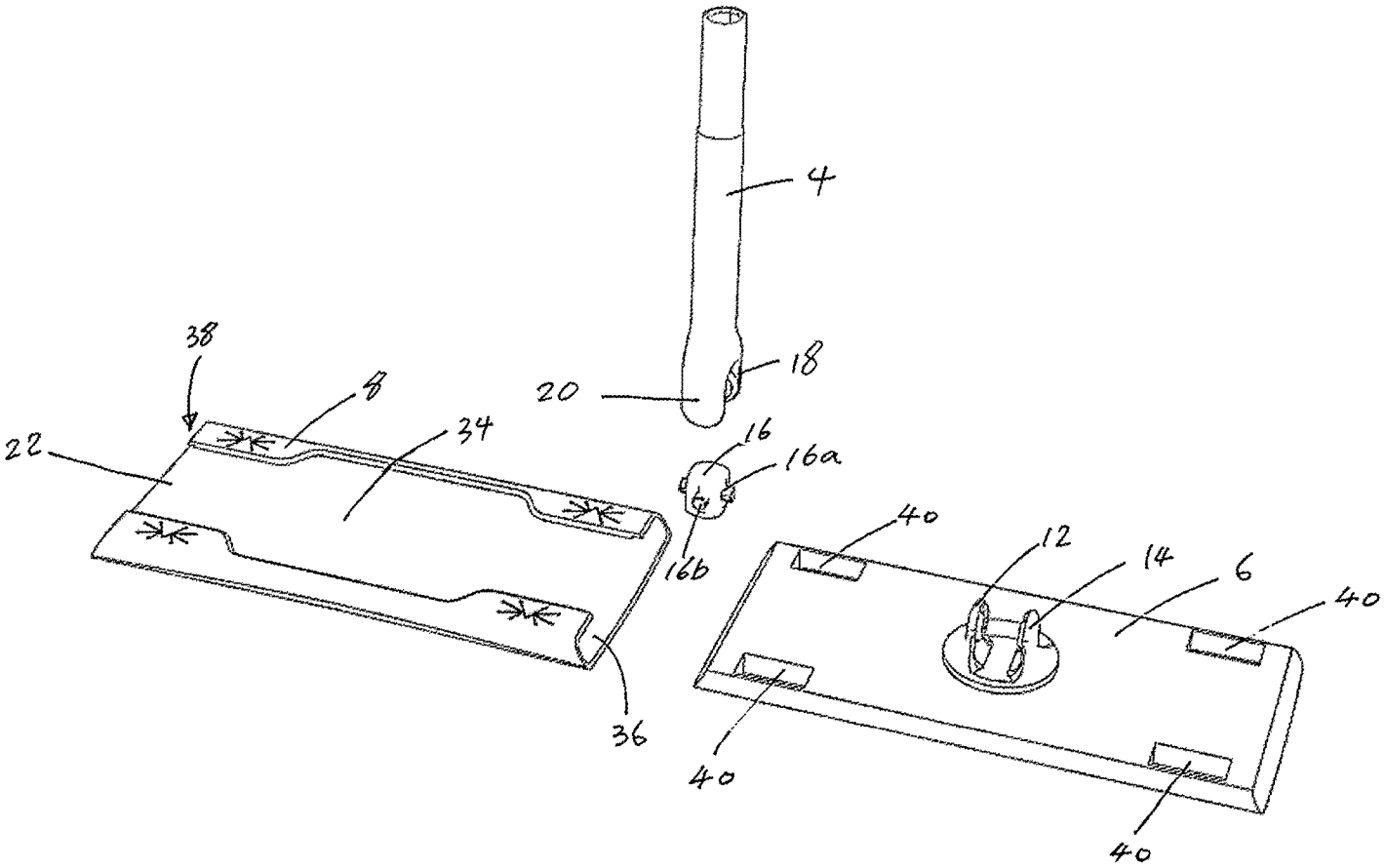
FIG. 2 is an exploded view of the device of FIG. 1.

A first embodiment of such device is shown in FIG. 1 and FIG. 2 and generally designated 2. As can be seen from FIG. 1, the device 2 has a handle 4, an upper member 6 in the form of a head and a lower member 8 in the form of a base. The upper and lower members 6, 8 together form a mop head. The upper member is made of a relatively stiff material for providing rigidity to the mop head. The lower member 8 is made of a material which is softer and more flexible compared to that of the upper member 6. A connection means is provided for allowing the handle 4 to pivotably swivable relative to the upper member 6.

FIG. 2 more clearly illustrates the construction of the device 2. The connection means include a seat 10 rotatably connected to an upwardly facing surface of the upper member 6. The seat 10 although fixedly connected to the upper member 8 can rotate 360° on the upper member 6. The seat 10 has two upstanding walls 12, 14 facing each other and is provided with two oppositely arranged openings. The connection means is provided with a connector 16. The connector 16 is provided with four fingers, including fingers 16*a*, 16*b*, facing forward, rearward, leftward and rightward directions, respectively. The two fingers facing leftward and rightward directions are received in the two openings of the seat 10. The forward and rearward fingers are received in opposite facing openings of two legs 18, 20 depending from lower end of the handle 4. It is thus envisaged that once assembled the handle 4 can become pivotably swivable with respect to the mop head in a large extent.

The lower member 8 generally takes the form of a sleeve. The sleeve has a lower planar member 22 with a front end and a rear end thereof curved upwardly. Portion 24 of the sleeve that is curved up is provided with grippers 26, 28, 30, 32 for securing cleaning substrate such as cleaning sheets. As can be seen from FIG. 2, a cavity 34 is defined between the grippers 26, 28, 30, 32 and the planar member 22. The height, width or otherwise dimension of the cavity 34 allows the upper member 6 to interference fit within the sleeve. The sleeve has opposite lateral openings 36, 38 via which the upper member 6 can slide into the cavity 34 from either of the openings 36, 38 and the upper member 6 is secured therein.

Four corners of the upper member 6 are provided with apertures 40. The upper member 6 is configured such that the apertures 40 are situated beneath the grippers 26, 28, 30, 32. Since the lower member 22 including the grippers 26, 28, 30, 32 are made of a soft material, in use when a sheet of cleaning fabric is wrapped around an outwardly facing surface of the planar member 22 edges of the cleaning fabric sheet can be pressed into the apertures 40 and the grippers 26, 28, 30, 32 with resilient fingers secure the edges and maintain the cleaning sheet fabric in position.

It is to be noted that the grippers 26, 28, 30, 32 and the sleeve 8 are integrally formed as one component, for example by injection molding. In other words, they are of one component and not separate components which require assembling. This is technically advantageously compared to the prior art in similarly constructed devices. The advantages come in two-fold. First, the integral design avoids the use of separate grippers which exist or form as standalone plugs. It can be envisaged that during use of the type of cleaning devices they undergo constant movement. The do away of separate grippers avoids the grippers dislodging from the base and accidentally releasing a cleaning fabric sheet unintentionally. Second, from a manufacture point of view the production of one integral component is economically advantageous over separate base and gripping plugs.

The manufacture of the integrally formed lower portion and grippers would encounter technical difficulties if conventional materials and techniques are used. In the above embodiment, thermoplastic elastomer (TPE) is used as a material in the lower member 8. However, other suitable materials such as ethylene-vinyl acetate (EVA) or materials with similar characteristics may be used.

Figure 3:
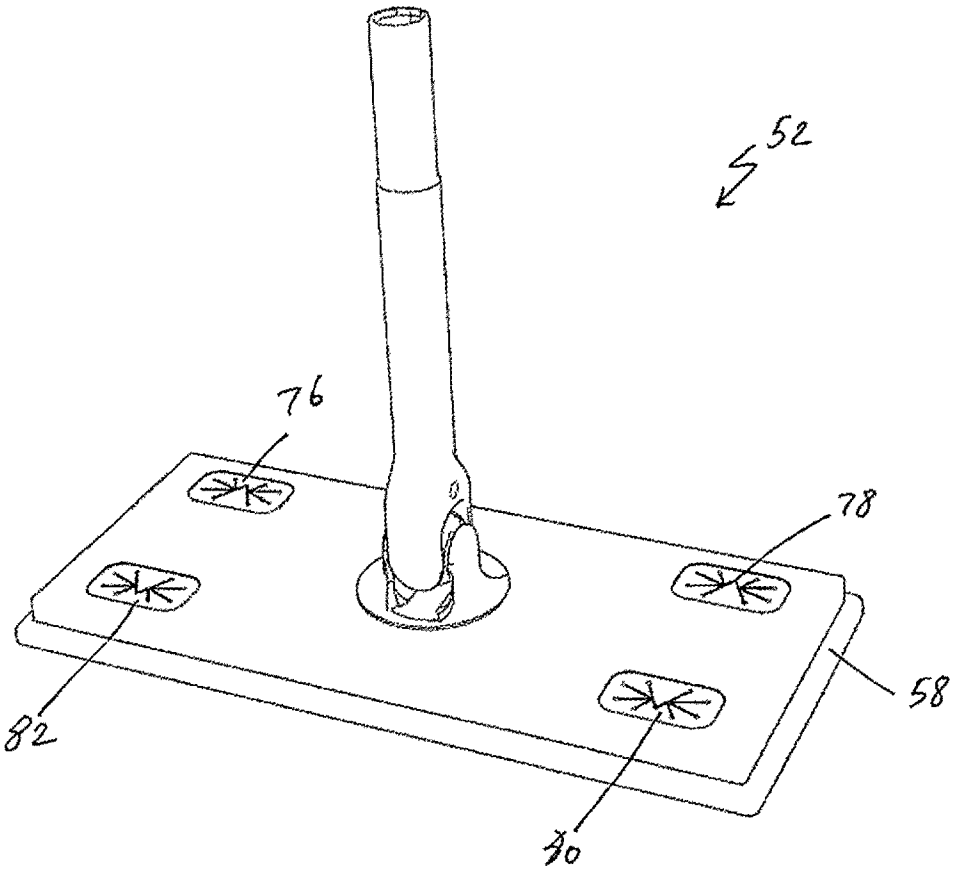
FIG. 3 is a perspective view of another embodiment of a surface cleaning device according to the present invention.
Figure 4:
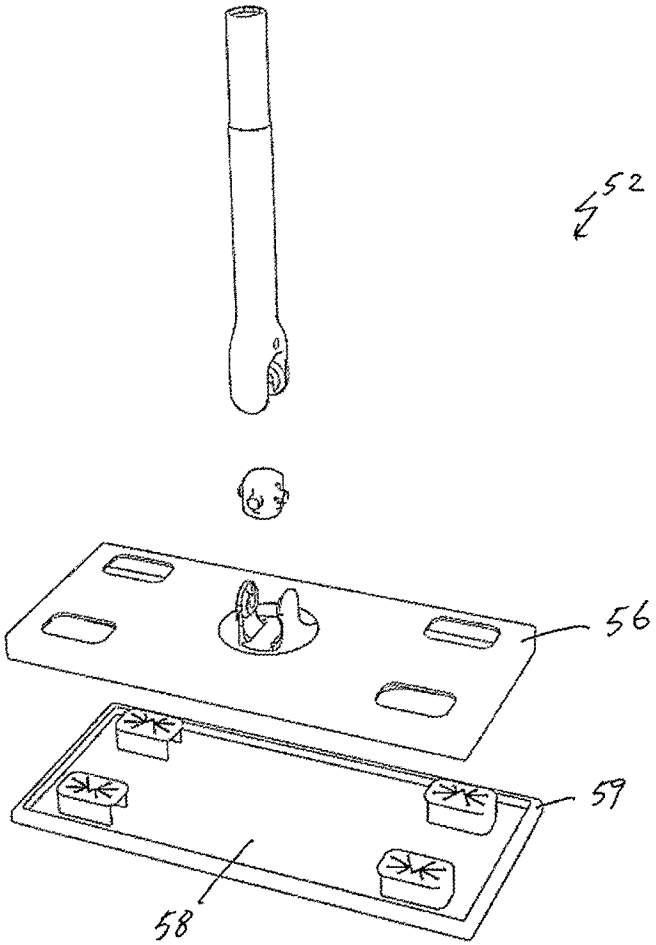
FIG. 4 is an exploded view of the device of FIG. 3.

FIG. 3 and FIG. 4 illustrate another embodiment of a cleaning device 52 according to the present invention. The device 52 is similar to the device 2. Only main differences of the device 52 are explained as follows.

Lower portion 58 or base of the device 52 is not in the form of a sleeve. Instead, the lower portion 58 has a thickened surrounding rim 59. Four grippers 76, 78, 80, 82 are provided which are raised from a lower planar member 72 of the base. The device 52 is configured such that upper member 56 or head of the device is snap-fittable to the lower member 58 at the rim 59. Similar to the device 2, on assembly the grippers 76, 78, 80, 82 protrude from openings at the corners of the upper member 56. In this embodiment, the lower portion and the upper portion are snap-fitted together so as to avoid the need perform an additional step of, for example, gluing or molding them together. Also similar to the device 2, the grippers 76, 78, 80, 82 and the base 58 are integrally formed.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

The invention claimed is:

1. A surface cleaning device comprising a handle via which a user holds on to said device and maneuvers said device during use, a head to which said handle connects, a base at which said head is secured and is situated, in normal use, below said head, in that said base is provided with, in normal use, a lower surface for engaging a surface to be cleaned via a removable or disposable substrate material, wherein:— a) said base is provided with a plurality of grippers for securing said disposable substrate material, both said base and said grippers belong to an integral component;

b) said integral component of said base and said grippers is made of an injection moldable material selected from a group including thermoplastics elastomer (TPE) and ethylene-vinyl acetate (EVA);

c) said base of said integral component resembles a sleeve and includes on one side a planar member defining the lower surface and on an opposite side said grippers, and wherein a cavity is defined between said grippers and said planar member for accommodating said head.

2. A surface cleaning device as claimed in claim 1, wherein said head is sized and shaped to fit within the cavity of said base of said integral component.

3. A surface cleaning device as claimed in claim 2, sized and shaped such that said head is securable within said base of said integral component by sliding into said base of said integral component from an opening at one end of said sleeve.

4. A surface cleaning device as claimed in claim 2, where said base is adapted to allow the removable or disposable substrate to wrap around said planar member.

5. A surface cleaning device as claimed in claim 1, sized and shaped such that said head is securable within said base of said integral component by sliding into said base of said integral component from an opening at one end of said sleeve.

6. A surface cleaning device as claimed in claim 1, wherein said head is provided with apertures located beneath said grippers, the apertures for receiving tugged edges of the removable or disposable substrate.

7. A surface cleaning device as claimed in claim 1, wherein said base has a cutout region via which connection means connecting said head and said handle protrudes.

8. A surface cleaning device as claimed in claim 1, wherein outwardly facing surface adjacent said grippers are roughened for improving frictional engagement of said removable or disposable substrate to said base during use.

9. A surface cleaning device as claimed in claim 1, wherein said base and said head are secured together by snap-fitting together.

10. A surface cleaning device as claimed in claim 9, wherein said base includes a planar member defining the lower surface and said integrally grippers are raised from said planar member.

11. A surface cleaning device as claimed in claim 10, wherein said planar member is provided with a thickened rim.

12. A surface cleaning device as claimed in claim 11, wherein said head is provided with apertures, and is configured such that on assembly said grippers are exposed or at least accessible for securing tugged edges of the removable or disposable substrate.

13. A surface cleaning device as claimed in claim 10, wherein said head is provided with apertures, and is configured such that on assembly said grippers are exposed or at least accessible for securing tugged edges of the removable or disposable substrate.

14. A surface cleaning device as claimed in claim 1, where said base is adapted to allow the removable or disposable substrate to wrap around said planar member.

15. A surface cleaning device as claimed in claim 1, configured such that said handle is pivotable swivable in forward, rearward or sideway direction.

16. A surface cleaning device as claimed in claim 1, provided with four said grippers located at four corners of said base.

17. A surface cleaning device comprising a handle via which a user holds on to said device and maneuvers said device during use, a head to which said handle connects, a base at which said head is secured and is situated, in normal use, below said head, in that said base is provided with, in normal use, a lower surface for engaging a surface to be cleaned via a removable or disposable substrate material, wherein said base is provided with a plurality of grippers for securing said disposable substrate material, said base and said grippers belong to an integral component, and wherein the grippers and the lower surface define a cavity therebetween for accommodating the head.

18. A surface cleaning device as claimed in claim 17, wherein said integral component of said base and said grippers is made of essentially thermoplastics elastomer (TPE) and formed by injection molding in one step.

19. A method of manufacture of a surface cleaning device as claimed in claim 1, wherein said integral component is an injection molded element.

* * * * *